US012465136B2

(12) United States Patent
Popp et al.

(10) Patent No.: US 12,465,136 B2
(45) Date of Patent: Nov. 11, 2025

(54) MULTI-USE HOLSTER

(71) Applicant: 6:8 MEDICAL SOLUTIONS LLC, Myrtle Beach, SC (US)

(72) Inventors: Uriah Shane Popp, Myrtle Beach, SC (US); David Saxman, Lincolnton, NC (US); Paul Stultz, Myrtle Beach, SC (US); Graham White, Savannah, GA (US)

(73) Assignee: 6:8 MEDICAL SOLUTIONS LLC, Myrtle Beach, SC (US)

( * ) Notice: Subject to any disclaimer, the term of this patent is extended or adjusted under 35 U.S.C. 154(b) by 444 days.

(21) Appl. No.: 17/945,926

(22) Filed: Sep. 15, 2022

(65) Prior Publication Data

US 2023/0080287 A1 Mar. 16, 2023

Related U.S. Application Data

(60) Provisional application No. 63/244,263, filed on Sep. 15, 2021, provisional application No. 63/326,380, filed on Apr. 1, 2022.

(51) Int. Cl.

| | |
|---|---|
| ***A45F 5/02*** | (2006.01) |
| ***A45F 3/14*** | (2006.01) |
| ***A45F 5/00*** | (2006.01) |

(52) U.S. Cl.

CPC ..... *A45F 5/021* (2013.01); *A45F 3/14* (2013.01); *A45F 2003/144* (2013.01); *A45F 5/1575* (2025.01)

(58) Field of Classification Search

CPC ..... A45F 5/02; A45F 5/021; A45F 3/14

USPC ..... 224/676

See application file for complete search history.

(56) References Cited

U.S. PATENT DOCUMENTS

| | | | | |
|---|---|---|---|---|
| 3,132,504 A * | 5/1964 | Beilis | A45C 11/323 | 29/896.9 |
| 3,392,427 A * | 7/1968 | Lane | F16B 21/09 | 24/628 |
| 5,511,336 A * | 4/1996 | Bishop | A01K 97/10 | 224/680 |
| 5,992,717 A * | 11/1999 | Clewes | A01K 97/10 | 224/584 |
| 6,269,993 B1 * | 8/2001 | Ebejer | G01B 3/1071 | 224/269 |

(Continued)

*Primary Examiner* — Nathan J Newhouse
*Assistant Examiner* — Lester L Vanterpool
(74) *Attorney, Agent, or Firm* — Outlier Patent Attorneys, PLLC

(57) ABSTRACT

A holster for attaching an item to a garment includes a baseplate having a central portion and a peripheral portion. The baseplate is made of a rigid or semi-rigid material. The central portion of the baseplate includes a first opening that is sized and shaped to accommodate a belt, strap, or MOLLE webbing. The holster additionally includes a plurality of notches in the peripheral portion of the baseplate. The plurality of notches are sized and shaped to accommodate a tethering member passing therethrough. The holster may be attached to the garment by engagement between the opening in the baseplate and the garment. The item to be carried in the holster is strapped to the holster with the tethering member. The holster may be provided as part of a kit that includes a top plate and the tethering member.

8 Claims, 12 Drawing Sheets

(56) References Cited

U.S. PATENT DOCUMENTS

| | | | | |
|---|---|---|---|---|
| 6,588,640 | B1 * | 7/2003 | Rogers | F41C 33/046 224/912 |
| 8,297,562 | B1 * | 10/2012 | Yeates | A45F 5/02 248/222.51 |
| 9,144,255 | B1 * | 9/2015 | Perciballi | A41D 27/00 |
| D820,003 | S * | 6/2018 | Capdepon | D6/553 |
| 10,143,294 | B1 * | 12/2018 | Matson | A45F 5/02 |
| D839,716 | S * | 2/2019 | Gertsma | D8/356 |
| 10,555,598 | B2 * | 2/2020 | Evans | A45F 5/02 |
| 10,571,220 | B2 * | 2/2020 | Toschi | F41C 33/04 |
| 11,054,216 | B1 * | 7/2021 | Rogers | F41C 33/045 |
| 11,530,897 | B2 * | 12/2022 | Smith | A45F 5/02 |
| 11,661,254 | B1 * | 5/2023 | Storms, Jr. | B65D 63/1027 24/712 |
| 11,940,092 | B1 * | 3/2024 | Foutz | B60R 7/14 |
| D1,020,423 | S * | 4/2024 | Crook | D12/406 |
| 11,992,097 | B1 * | 5/2024 | Wagner | A45F 5/021 |
| D1,048,720 | S * | 10/2024 | Gee | D3/319 |
| 2009/0277936 | A1 * | 11/2009 | Rogers | A45F 5/02 24/647 |
| 2012/0175390 | A1 * | 7/2012 | Rogers | F41C 33/045 29/453 |
| 2012/0315785 | A1 * | 12/2012 | Taylor | H01R 43/01 439/389 |
| 2015/0189977 | A1 * | 7/2015 | Thompson | A45F 5/02 24/3.7 |

* cited by examiner

MULTI-USE HOLSTER

CROSS-REFERENCE TO RELATED APPLICATIONS

This application claims priority to U.S. Provisional Patent Application No. 63/244,263, entitled "Multi Holster" and filed on Sep. 15, 2021, the contents of which are hereby incorporated herein by reference. In addition, this application claims priority to U.S. Provisional Patent Application No. 63/326,380, entitled "Multi Holster" and filed on Apr. 1, 2022, the contents of which are hereby incorporated herein by reference.

BACKGROUND

Field of the Art

This disclosure relates to a holster for carrying a small item and removably attaching the small item to a MOLLE carrying system or to a belt. In particular, this disclosure relates to a holster that attaches to a MOLLE system or a belt and to various items that a user may want to carry and access easily and quickly.

Discussion of the State of the Art

The term "MOLLE" is an acronym for "Modular Lightweight Load-carrying Equipment," which is a lightweight and modular system for carrying gear. MOLLE systems include rows of heavy-duty nylon fabric stitched to load-bearing platforms, such as backpacks, vests, belts, cummerbunds, or the like, to form a system of loops to which the gear can be attached. Weapons, knives, flashlights, cell phones, tools, medical equipment, or the like may be attached to a MOLLE system. The gear attached to the MOLLE system is secured in place and is quickly and easily accessible.

Most holsters or pouches made to connect with MOLLE webbing require extra weaving straps or rigid flat bars that are woven between the webbing of the pouch and the MOLLE webbing to secure them in place. Holsters attached directly to belts require belt loops or attachments to be screwed on or are sewn in place to secure them to the belt.

There is a need for a device that easily and securely attaches to a belt or to MOLLE webbing in an unobtrusive manner. The device is preferably universally configured to carry various desired items that a user may want to access quickly.

SUMMARY

A multi-use holster in accordance with the present invention eliminates extra needed webbing, straps, or sewing by incorporating cutouts and keyholes for attachments, making the holster able to connect directly onto MOLLE webbing, various sized belts, straps, or the like. The multi-use holster includes a series of key holes configured for routing bungee retention rope in various patterns to allow the user to secure objects of different shapes and sizes onto the holster. However, it should be noted that the invention is not limited to use with bungee cords and may be attached to items using different attachment means, such as flat elastic material, nylon straps, or the like. The multi-use holster is made up of a base plate with a series of cutouts and holes that provide a securing interface between MOLLE webbing, or a belt or strap. Items can then be secured to the base plate using bungee cord routed through locking "key" holes. The MOLLE, or belt cut outs, can be in a horizontal or vertical configuration. The MOLLE cut outs have an upper locking "T" design that prevent it from sliding back out of the MOLLE webbing once the base plate is affixed to the MOLLE webbing.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION

Figure 1A:
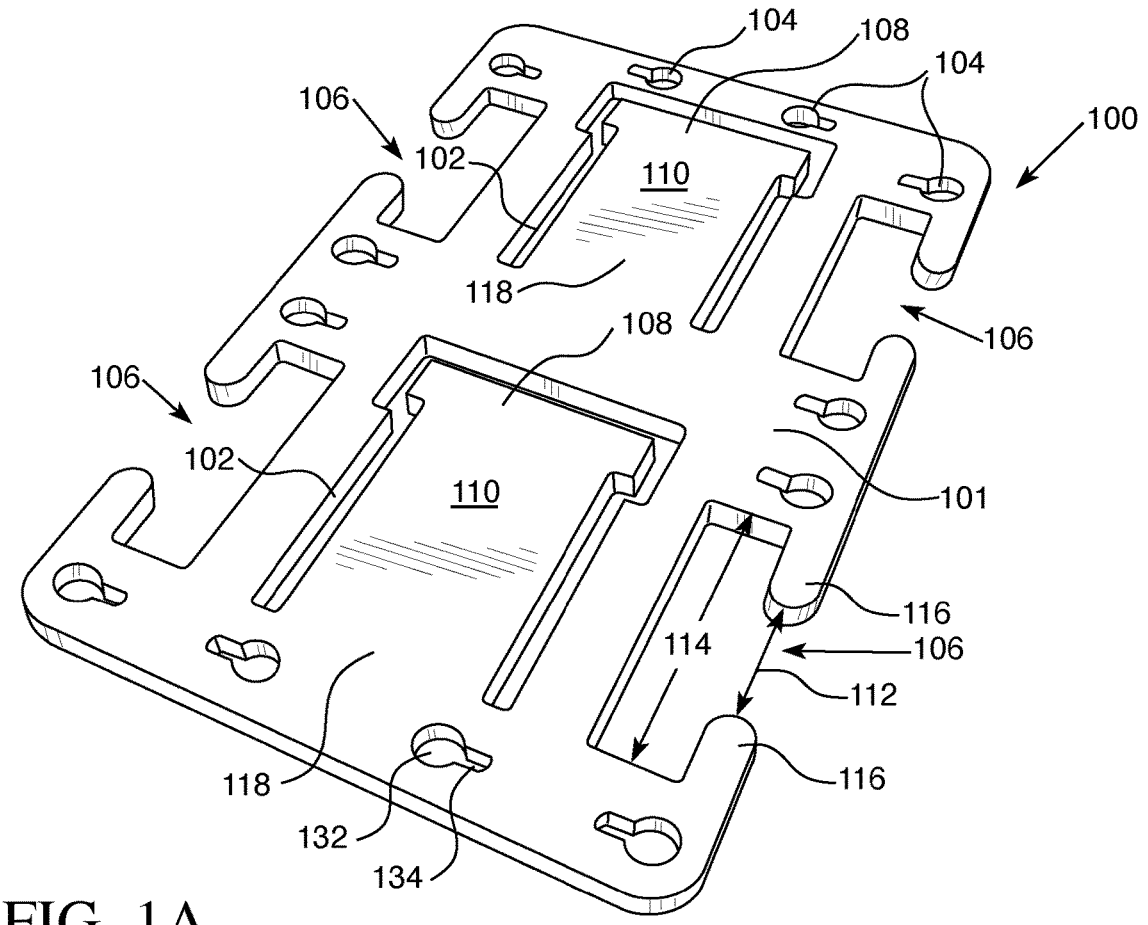
FIGS. 1A and 1B are perspective and plan views, respectively, of a holster for attaching objects to MOLLE webbing in a vertical orientation, in accordance with one embodiment of the present invention.

The inventor has conceived, and reduced to practice, an apparatus for securing items to MOLLE webbing, a belt, a strap, or the like. The apparatus is a holster that includes a base plate that serves as a holster through a design that allows for setting and locking retention. The holster is intended to hold multiple items by adjusting the locking tension on key holes placed in various locations on a base plate. The key hole cut outs have a locking notch, thereby allowing bungee rope to slide freely or be locked in place for consistent retention. The base plate additionally has T-shaped cut outs or belt slots for securing the base plate to MOLLE webbing, belts, or straps. The T-shaped cutouts lock the MOLLE webbing in place once the upper portion of the T-shaped cutouts passes through the MOLLE webbing. In the vertical mounting variation, one T-shaped cutout is slightly shorter than the other to allow the user to weave the T-shaped cutouts under the MOLLE webbing easier. In the horizontal mounting configuration, the T-shaped cutouts are the same length for consistent alignment with the MOLLE webbing.

The invention is described by reference to various elements herein. It should be noted, however, that although the various elements of the inventive apparatus are described separately below, the elements need not necessarily be separate. The various embodiments may be interconnected and may be cut out of a singular block or mold. The variety of different ways of forming an inventive apparatus, in accordance with the disclosure herein, may be varied without departing from the scope of the invention.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

Overview

The apparatus of the present invention is a holster for securely attaching an item to a garment. The garment may be MOLLE webbing, belts, straps, or the like. In one example, the holster includes a baseplate, openings in the central portion of the baseplate, and keyhole notches surrounding the openings. In one particular example, the openings in the baseplate form T-shaped tabs, and the holster further includes side tabs adjacent to the T-shaped tabs. The T-shaped tabs and the side tabs are sized and shaped to engage with loops in MOLLE webbing. The keyhole notches are configured to engage with an elastic shock cord for attaching items to the holster. In this manner, objects can be attached to a load-bearing platform using the holster and the MOLLE webbing to secure the objects in any desired location that is preferably quickly and easily accessible. The holster can easily be repositioned to accommodate the needs of the user.

Apparatus

Figure 1B:
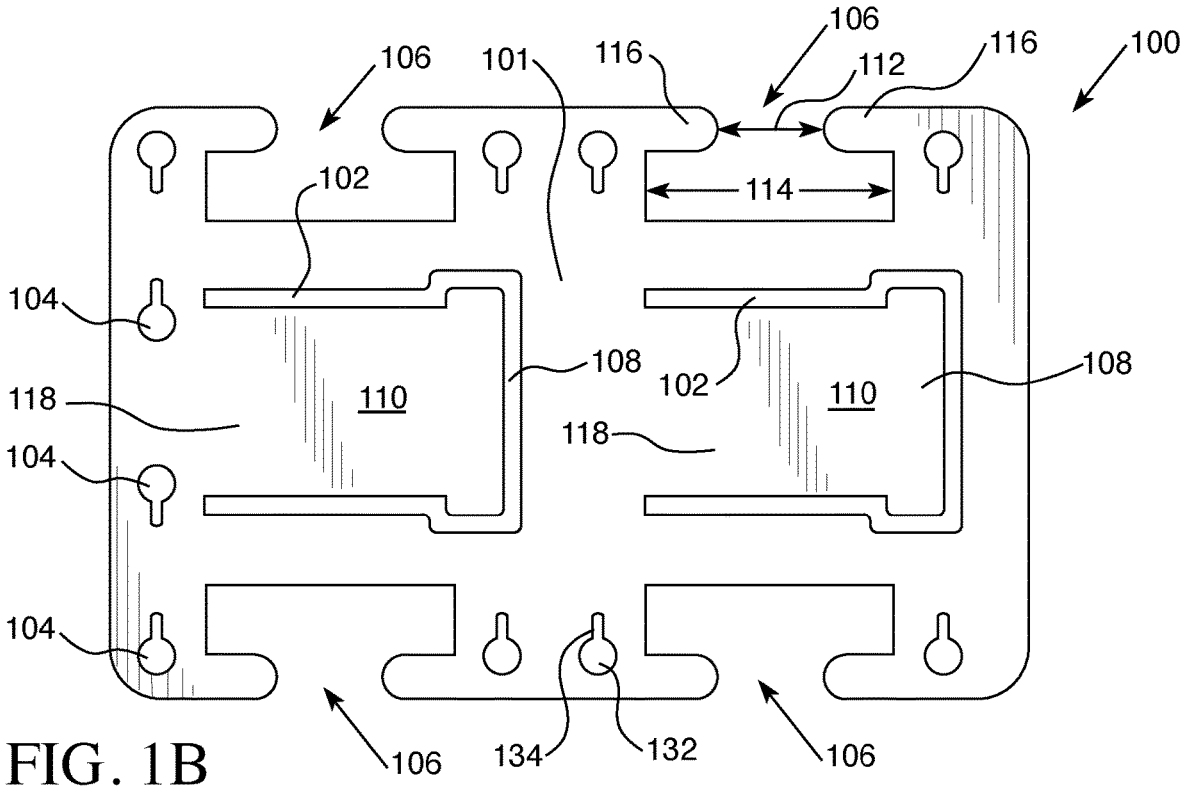

FIGS. 1A and 1B illustrate the inventive apparatus 100 in accordance with an embodiment of the invention. In particular, FIGS. 1A and 1B illustrate a holster 100 having a baseplate 101 that includes two openings 102 in a central portion of the baseplate 101. In this example, the openings 102 are channels that surround T-shaped tabs 110. The apparatus 100 is flat. Thus, the T-shaped tabs 110 are coplanar with the baseplate 101. A plurality of key hole notches 104 are disposed in a peripheral portion of the baseplate 101 surrounding the T-shaped tabs 110. The apparatus 100 further includes side tabs 106 adjacent to the T-shaped tabs 110 and positioned around the peripheral portion of the baseplate 101. The T-shaped tabs 110 are positioned in the middle of the base plate 101 and the key hole notches 104 are positioned around the periphery of the base plate 101. The base plate 101 is made of a rigid or semi-rigid material, such as hard plastic, metal, acrylic, or the like. Although the apparatus 100 depicted in FIGS. 1A and 1B includes two T-shaped tabs 110, it should be well understood by one of ordinary skill in the art that the apparatus 100 is not limited to two T-shaped tabs. Rather, the apparatus may include only one T-shaped cut out, or more than two T-shaped cut outs, depending on the needs of the user.

The T-shaped tabs 110 and the side tabs 106 are sized and shaped to engage with loops in MOLLE webbing. The T-shaped tabs 110 include open top ends 108 and base portions 118 that extend from the central portion of the baseplate 101. Further, the upper portion of the T-shaped tabs 110 (the portion closest to the open top end 108) is enlarged relative to the base portion 118 of the T-shaped tabs 110. In one embodiment, one of the T-shaped tabs 110 is slightly shorter than the other to facilitate weaving the T-shaped tabs 110 under the MOLLE webbing. The side tabs 106 include a narrow opening 112 in communication with a wider opening 114. The narrow openings 112 are formed by protrusions 116.

Figure 2A:
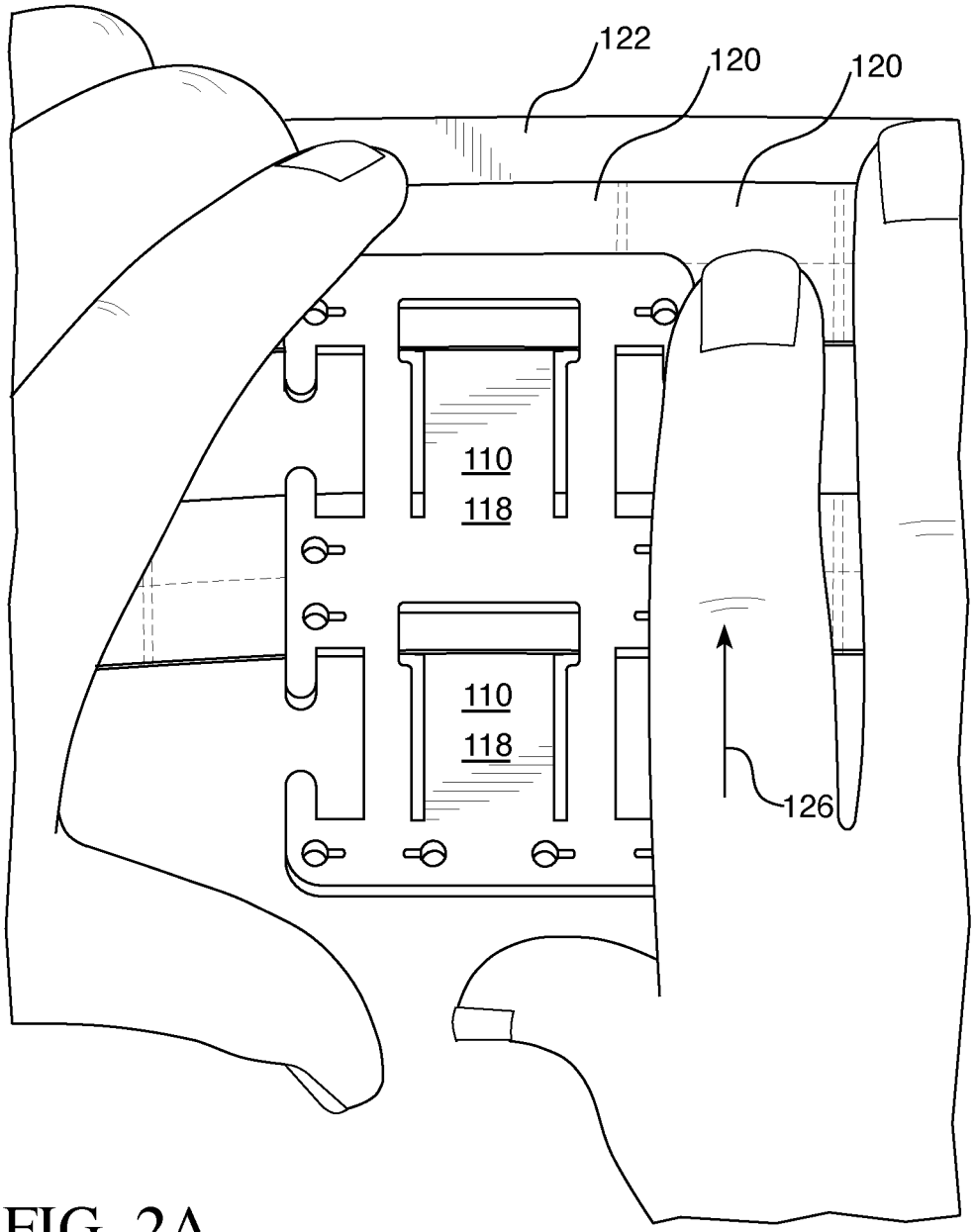
FIGS. 2A-2C illustrates steps in a method for attaching the holster to a garment, in accordance with one embodiment of the present invention.
Figure 2B:
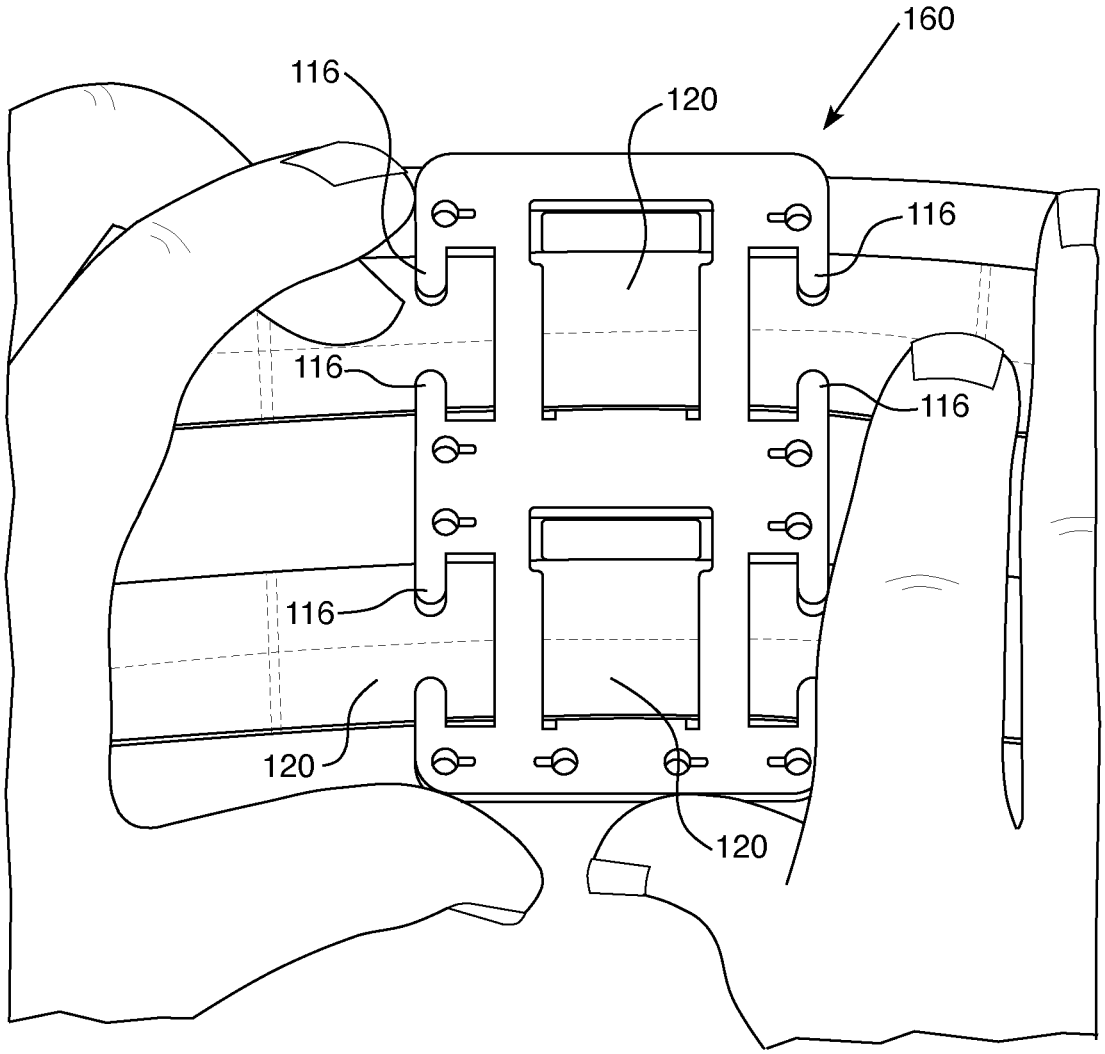
Figure 2C:
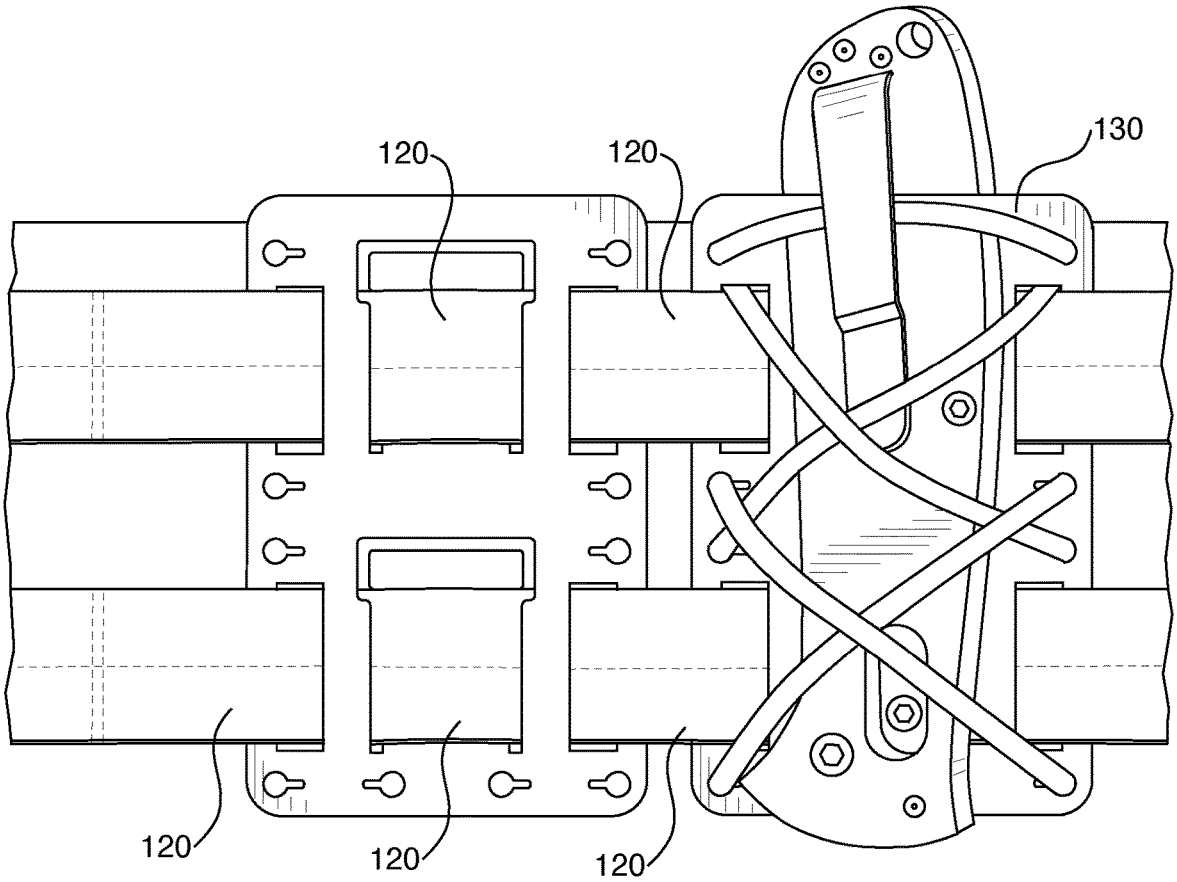

Referring now to FIGS. 2A-2C, the procedure for attaching the holster 100 to MOLLE webbing will be described. MOLLE webbing includes a series of loops 120 stitched to a load-bearing platform 122, such as a backpack, belt, strap, or the like. In order to attach the holster 100 to the MOLLE webbing, the baseplate 101 is positioned on top of the MOLLE webbing with the top ends 108 of the T-shaped tabs 110 adjacent to the bottoms of the loops 120 in the MOLLE webbing. The top ends 108 of the T-shaped tabs 110 are then positioned behind the loops 120 in the MOLLE webbing, as shown in FIG. 2A. Next, the baseplate 101 is pushed upwards 126 relative to the loops 120 until the bottoms of the loops 120 engage with the closed bottom ends 118 of the T-shaped tabs 110 and the enlarged upper portions 108 of the T-shaped tabs 110 are adjacent to the tops of the loops 120, as shown in FIG. 2B. The protrusions 116 are then tucked behind the loops 120, as shown in FIG. 2C. The upper T-shaped tab 110 is coupled to a first loop 120 in the MOLLE webbing. The protrusions 116 adjacent to either side of the upper T-shaped tab 110 are coupled to second and third loops 120 in the MOLLE webbing. The second and third loops 120 are adjacent to either side of the first loop 120. The lower T-shaped tab 110 is coupled to a fourth loop 120 in the MOLLE webbing. The protrusions 116 adjacent to either side of the lower T-shaped tab 110 are coupled to fifth and sixth loops 120 in the MOLLE webbing. The fifth and sixth loops 120 of the Molle webbing are adjacent to either side of the fourth loop 120. As such, the holster 100 is coupled to six adjacent loops 120 in the MOLLE webbing.

With the holster 100 securely attached to the MOLLE webbing as shown in FIG. 2C, items may be attached to the baseplate 101 using elastic shock cord 130 that passes through the keyhole notches 104. As shown in FIG. 2C, a folding knife is attached to a baseplate 101 using shock cord 130. The baseplate 101 is not limited to use with elastic shock cord 130. Rather, it will be well understood by one of ordinary skill in the art that other attachment means may be used to attach items to the baseplate 100. For example, flat elastic material, nylon straps, or the like may be used to attach items to the baseplate 101.

The shock cord 130 may freely pass through the larger, round portion 132 (shown in FIGS. 1A and 1B) in the keyhole notches 104 because the diameter of the larger round portion 132 of the keyhole notches 104 is larger than the outer diameter of the shock cord 130. In order to lock the shock cord 130 into place, the shock cord 130 is slid into the narrower portion 134 of the keyhole notches 104, which has a smaller width or diameter than the shock cord 130. Thus, the shock cord 130 is pinched within the narrower portion 134 of the keyhole notches 104, thereby preventing the shock cord 130 from sliding relative to the baseplate 101. Alternatively, the baseplate 101 may include round notches rather than keyhole shaped notches. The shock cord 130 may pass freely through the round notches and may be knotted to lock into place when desired tension is achieved.

Figure 3:
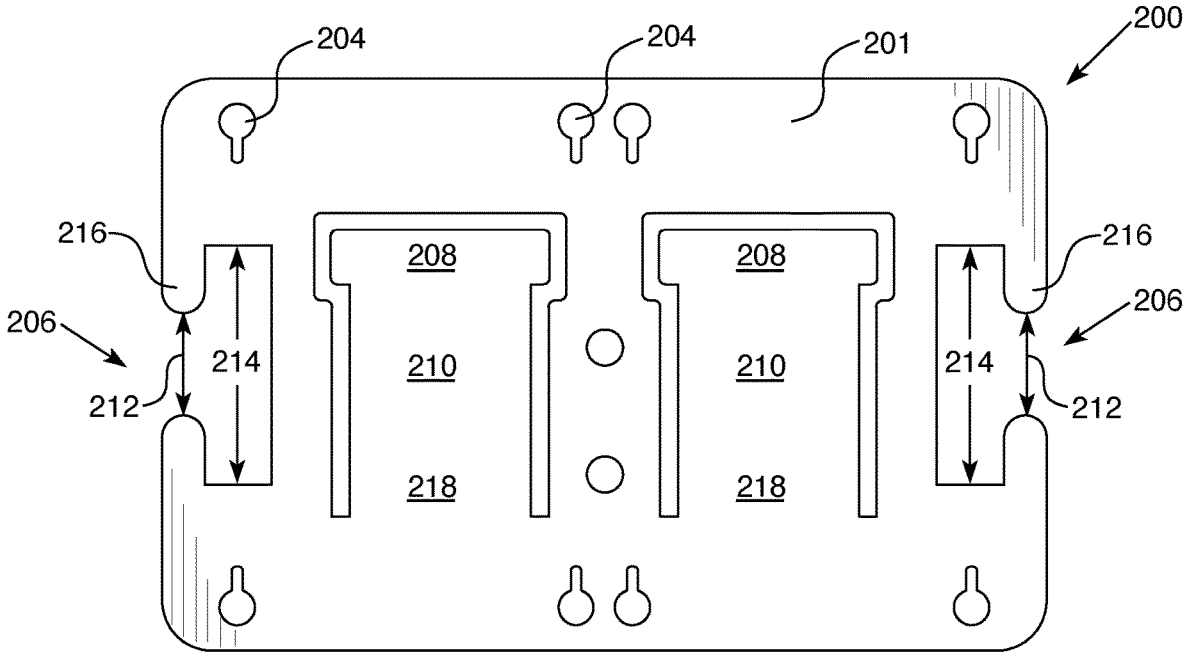
FIG. 3 is a plan view of a holster for attaching objects to MOLLE webbing in a horizontal orientation, in accordance with one embodiment of the present invention.

The holster 100 shown in FIGS. 1A-2C is configured to be positioned vertically relative to the MOLLE webbing. In another embodiment, shown in FIG. 3, a holster 200 is configured to be positioned horizontally relative to the MOLLE webbing. The features of the horizontal holster 200 are similar to those of the vertical holster 100. In particular, the horizontal holster 200 includes T-shaped tabs 210 having open top ends 208 and closed bottom ends 218. The horizontal holster 200 further includes a plurality of keyhole notches 204 for engaging with elastic shock cord, flat elastic material, nylon straps, or other similar attachment mechanisms. The T-shaped tabs 210 are in the middle of the baseplate 201 and the key hole notches 204 are positioned around the periphery of the baseplate 201. The horizontal holster 200 further includes side tabs 206 adjacent to the T-shaped tabs 110. The side tabs 206 include a narrow opening 212 that leads to a wider opening 214. The narrow opening 212 is formed by protrusions 216. The horizontal holster 200 attaches to four adjacent loops in one row of MOLLE webbing. In contrast, the vertical holster 100 attaches to two adjacent rows in the MOLLE webbing. That is, the vertical holster 100 attaches to three loops 120 in an upper row and three loops 120 in a lower row, wherein the lower three loops are directly below the upper three loops. As disclosed above, one of the T-shaped tabs 110 may be shorter than the other one to make installing the holster 100 easier. In another embodiment, the T-shaped tabs are the same size. For example, with the horizontal holster 200, the T-shaped tabs 210 may be the same size.

Figure 4A:
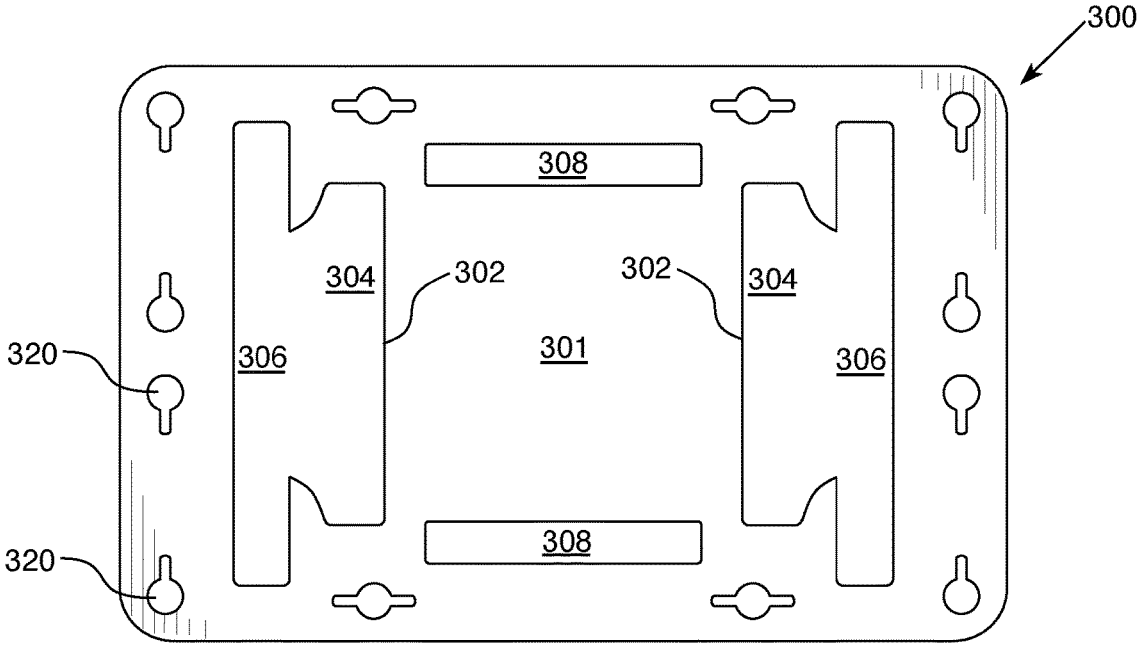
FIG. 4A is a plan view of a holster for attaching items to a belt or strap in either a horizontal or vertical orientation, in accordance with one embodiment of the present invention.
Figure 4B:
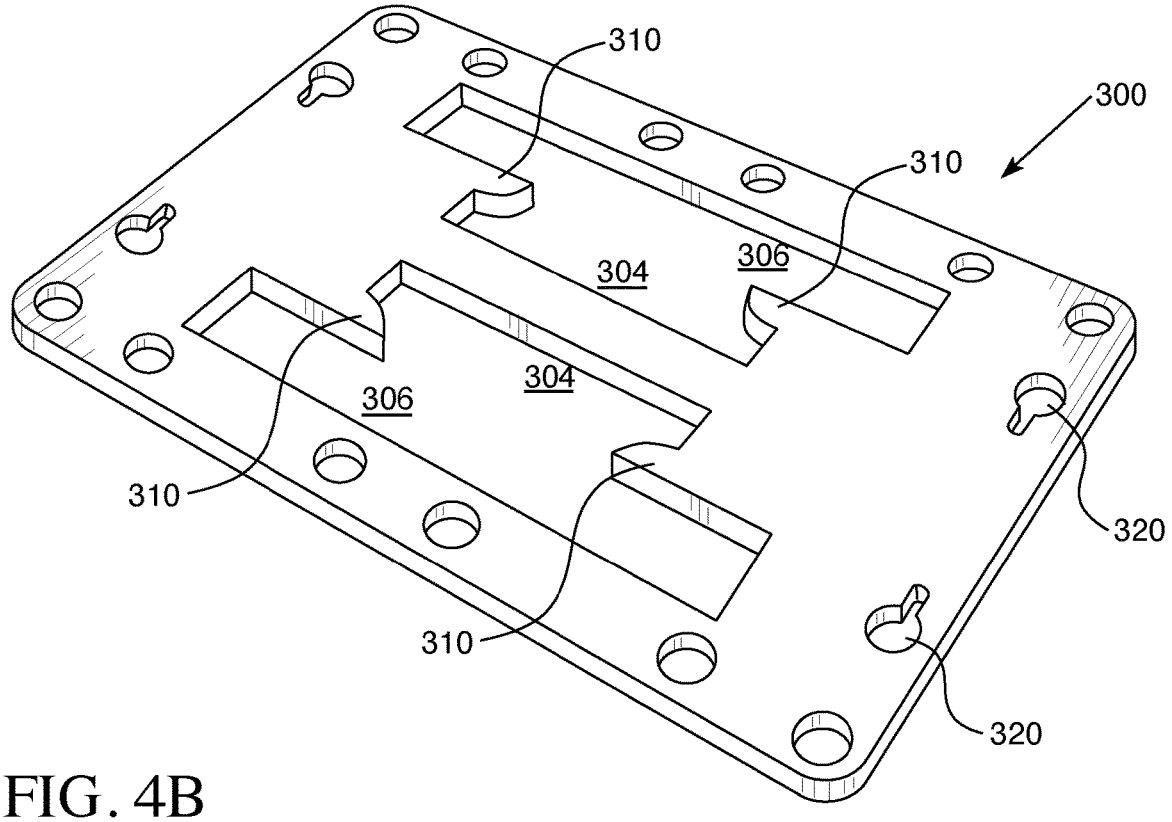
FIGS. 4B and 4C are perspective views of holster for attaching items to a belt or strap in a vertical orientation and a horizontal orientation, respectively, in accordance with one embodiment of the present invention.
Figure 4C:
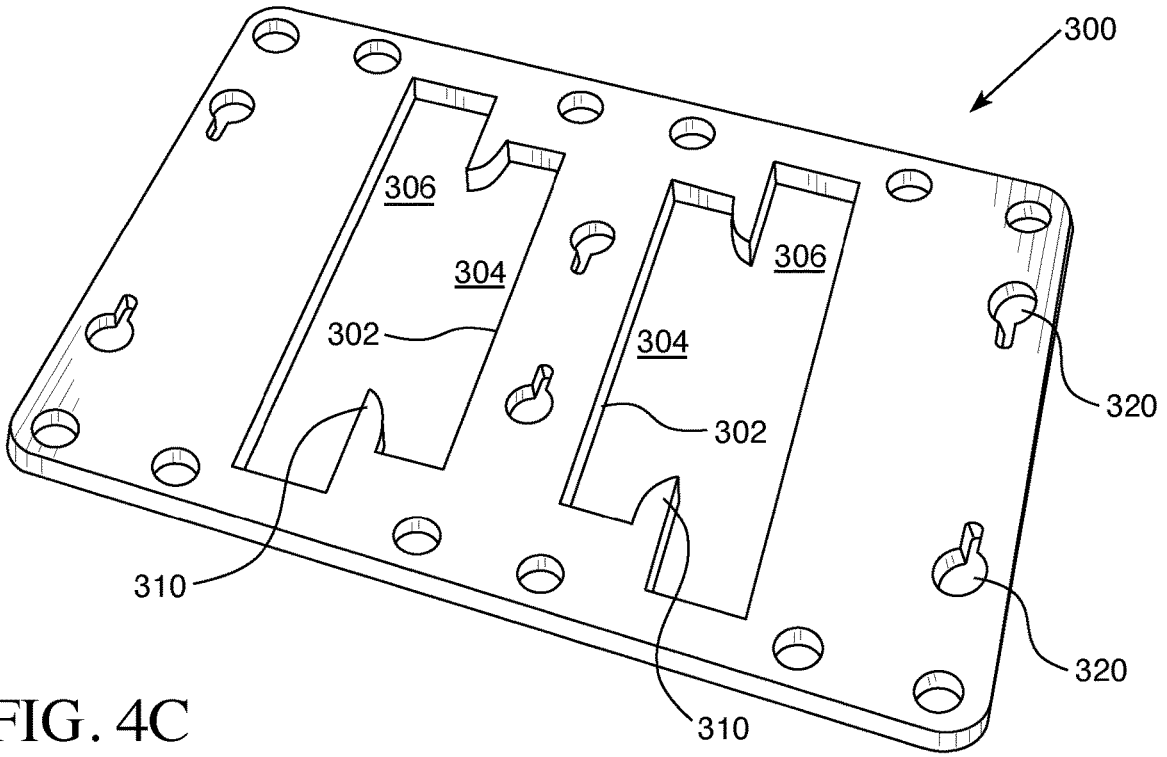

FIGS. 4A-4C depict examples of holsters 300 that are configured for being attached to belts or straps rather than MOLLE webbing. In general, the holsters 300 include openings in the central portion of the baseplate 301. The openings have a substantially rectangular shape so that a belt or strap may be woven through the openings. The holster 300 in FIG. 4A may be positioned vertically or horizontally. The holster 300 may be attached to belts or straps having different widths. The openings 302 are horizontal cutouts 302 having two different sizes. The horizontal cutouts 302 have a narrower portion 304 and a wider portion 306. The narrower portion 304 and the wider portion 306 each have a generally rectangular shape in order to accommodate a belt or a strap. The teeth, or wedge-shaped protrusions 310, that extend into the opening 302 between the narrower portion 304 and the wider portion 306 keep the belt or strap in place. The holster 300 further includes openings 308 that are vertically-oriented rectangular cutouts 308 configured to engage with a belt or strap.

Figure 5:
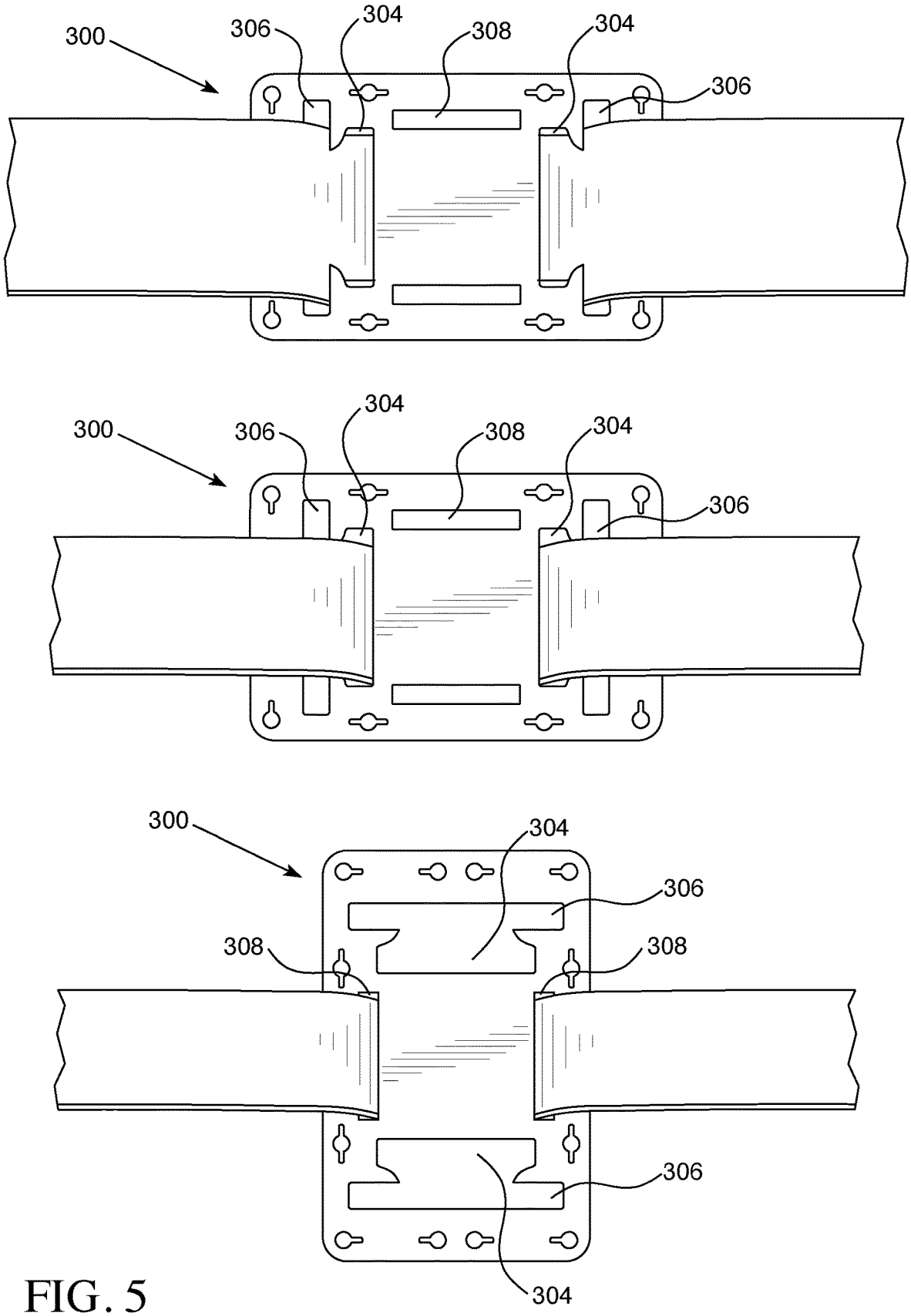
FIG. 5 is a plan view of the holster from FIG. 4A attached to different sized belts, in accordance with one embodiment of the present invention.

FIG. 5 depicts the holster 300 from FIG. 4A attached to different sized belts. In order to attach the holster 300 to a belt or strap in a vertical configuration, the belt or strap is threaded through the vertical cutouts 308, as shown at the bottom of FIG. 5. In order to attach the holster 300 to a belt or strap in a horizontal configuration, the belt or strap is threaded through the horizontal cutouts 302. If the belt or strap is narrower, the narrower portion 304 of the horizontal cutouts 302 may be used, as shown in the middle of FIG. 5.

If the belt or strap is thicker, the wider portion 306 of the horizontal cutouts 302 may be used, as shown at the top of FIG. 5. The vertical cutouts 308 may be narrower than the narrower portion 304 of the horizontal cut outs 302. For example, the wider portion 306 of the horizontal cut outs 302 may accommodate a belt having a width up to 2 inches. The narrower portion 304 of the horizontal cut outs 302 may accommodate a belt having a width up to 1.5 inches. The vertical cut outs 308 may accommodate a belt having a width up to 1 inch. All of the cut outs 304, 306, 308 are positioned towards the middle of the base plate 301.

The holsters 300 depicted in FIGS. 4B and 4C are vertically oriented and horizontally oriented, respectively. The openings 302 in the holster 300 in FIG. 4B are configured so that the holster 300 will be oriented vertically relative to a belt or strap woven through the openings 302 in the horizontal direction. In contrast, the openings 302 in the holster 300 in FIG. 4C are configured so that the holster 300 will be oriented horizontally relative to a belt or strap woven through the openings 302 in the horizontal direction. The openings 302 include a narrower portion 304 and a wider portion 306 to accommodate belts or straps having different widths, as discussed above. The teeth, or wedge-shaped protrusions 310, that extend into the opening 302 keep the belt or strap in place. The teeth 310 are positioned between the narrower portion 304 and the wider portion 306 of the opening 302.

The holsters 300 in FIGS. 4A-4C further include keyhole notches 320 for engaging with elastic shock cord. The keyhole notches 320 are positioned around the periphery of the baseplate 301 and are closer to the edges of the baseplate 301 than the cut outs 304, 306, 308. As discussed above, rather than the keyhole notches 320, the holster 300 may alternatively include round notches and the elastic shock cord may be knotted to prevent passage through the notches when desired tension is achieved. Further, the holster 300 is not limited to use with elastic shock cord. Other attachment mechanisms may be used to attach items to the holster 300. For example, flat elastic material, nylon straps, or other similar attachment mechanisms may be used.

Figure 6:
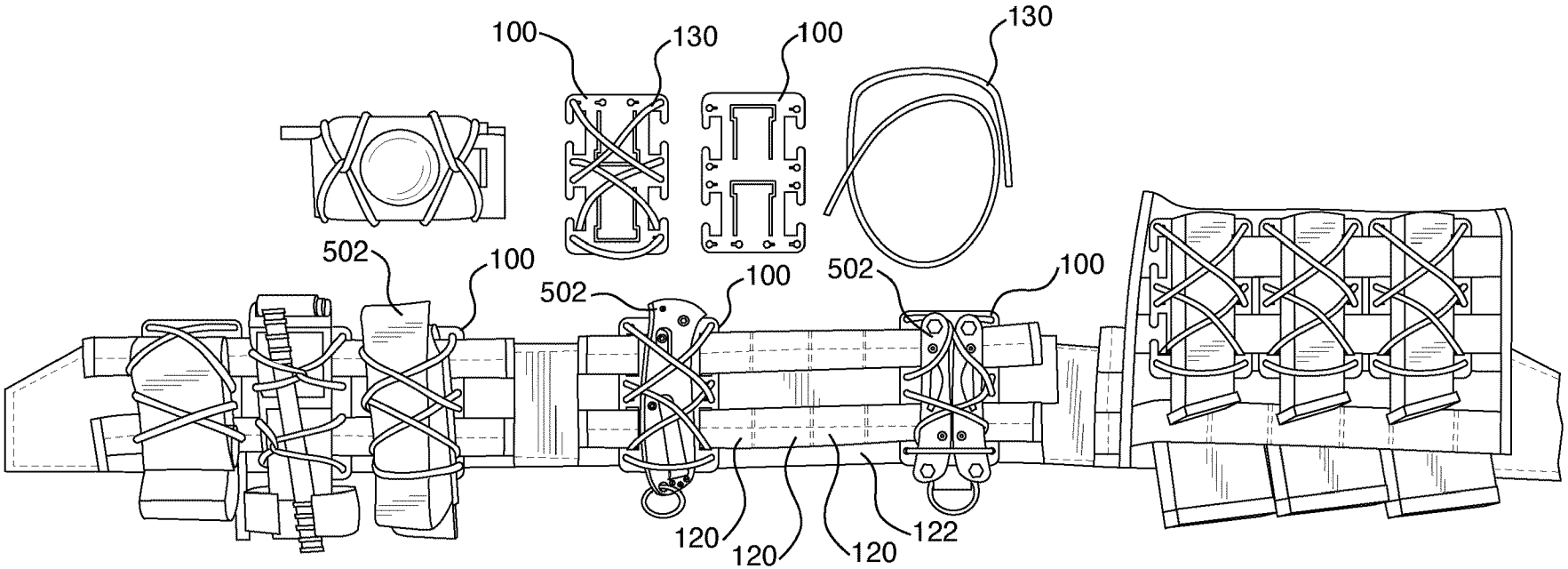
FIG. 6 is a plan view of the holster from FIGS. 1A and 1B in use, in accordance with one embodiment of the present invention.

FIG. 6 depicts a belt that includes MOLLE webbing. The MOLLE system includes loops 120 attached (e.g., by stitching) to a load-bearing platform 122 such as a belt or cummerbund. FIG. 6 further depicts a vertical holster 100 separated from an elastic shock cord 130, a vertical holster 100 and shock cord 130 assembled together, and a plurality of vertical holsters 100 attached to the MOLLE webbing. Vertical holsters 100 are attached to the MOLLE webbing in several desired positions and the various tools 502 are attached to the holsters 100 using elastic shock cord 130. In this manner, the various tools 502 are securely attached, but can be detached with moderate effort. Further, the various tools 502 are conveniently positioned in desired locations that are preferable to the user and can easily be re-positioned as desired.

In another example, the holster may include a top plate removably coupled to the baseplate. The items to be attached to the garment may be sandwiched between the baseplate and the top plate that are coupled together with the elastic shock cord. In this manner, it may be easier for the items to be removed from the holster because the items will not get tangled or hung up on the elastic shock cord.

Figure 7A:
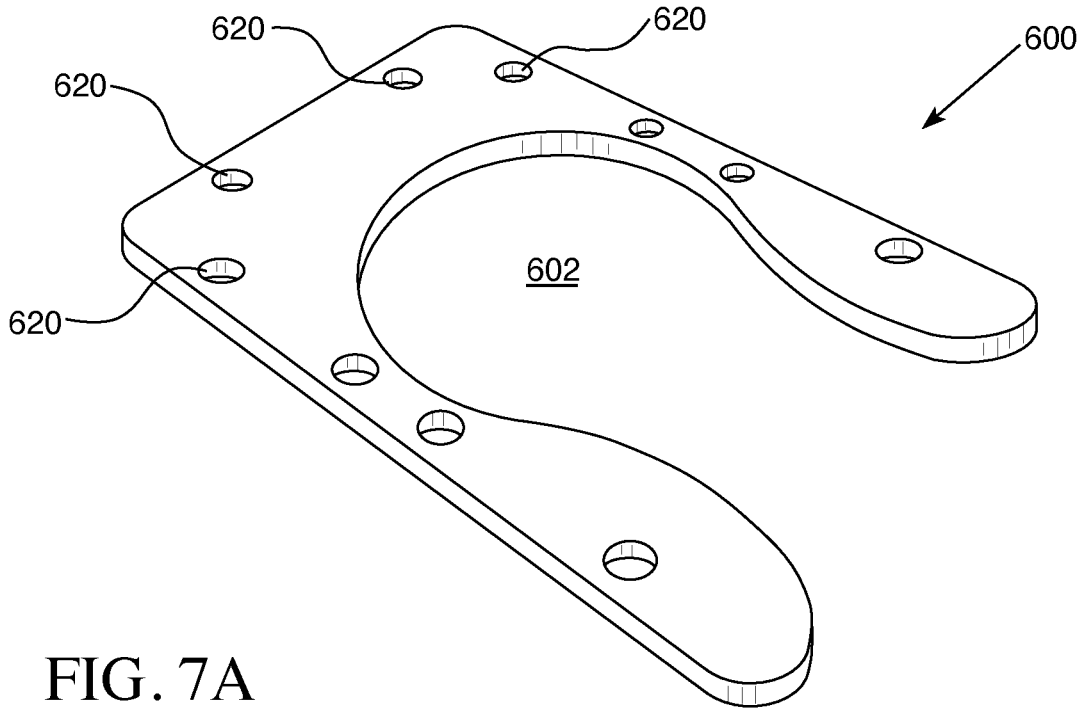
FIGS. 7A and 7B are perspective views of top plates that may be removably attached to the baseplates with desired items sandwiched therebetween, in accordance with one embodiment of the present invention.
Figure 7B:
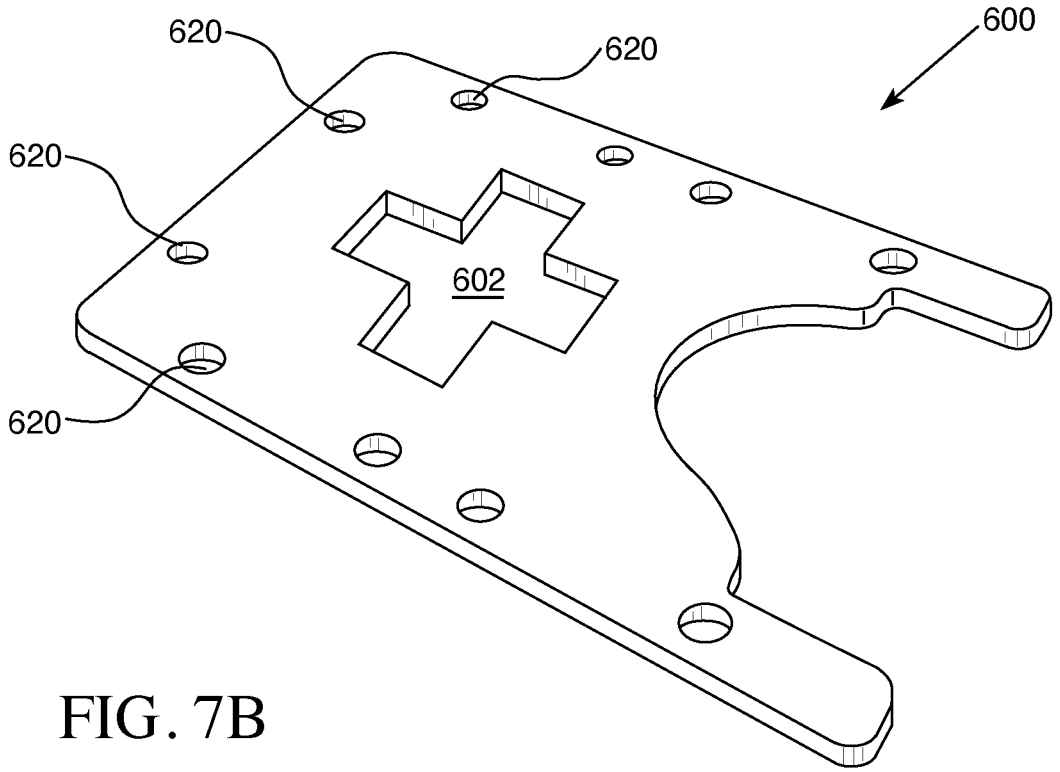
Figure 8A:
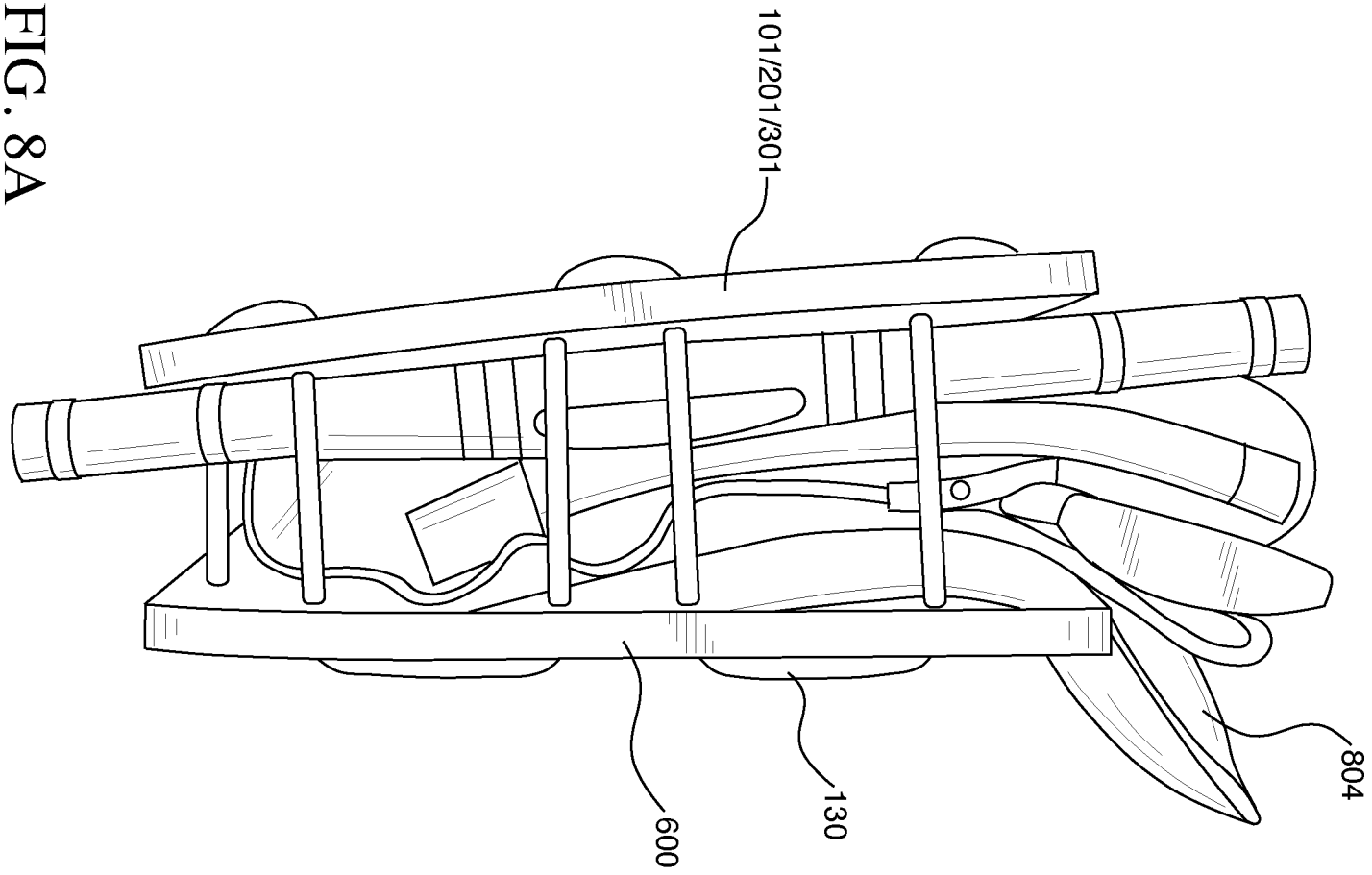
FIGS. 8A-8E illustrate use of the kit that includes the top plate, baseplate, and tethering member, in accordance with one embodiment of the present invention.
Figure 8B:
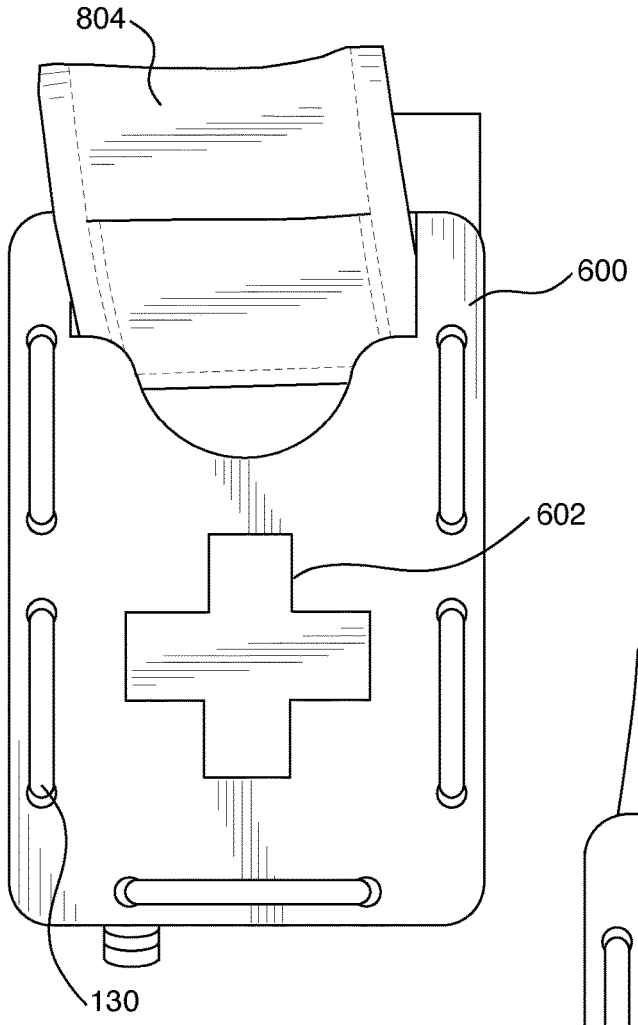
Figure 8C:
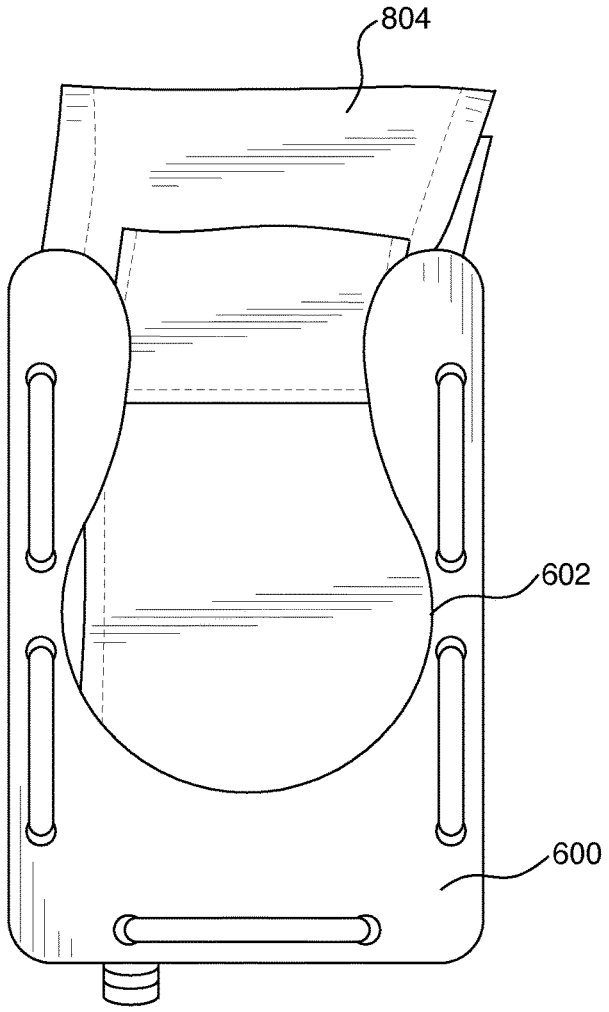
Figure 8D:
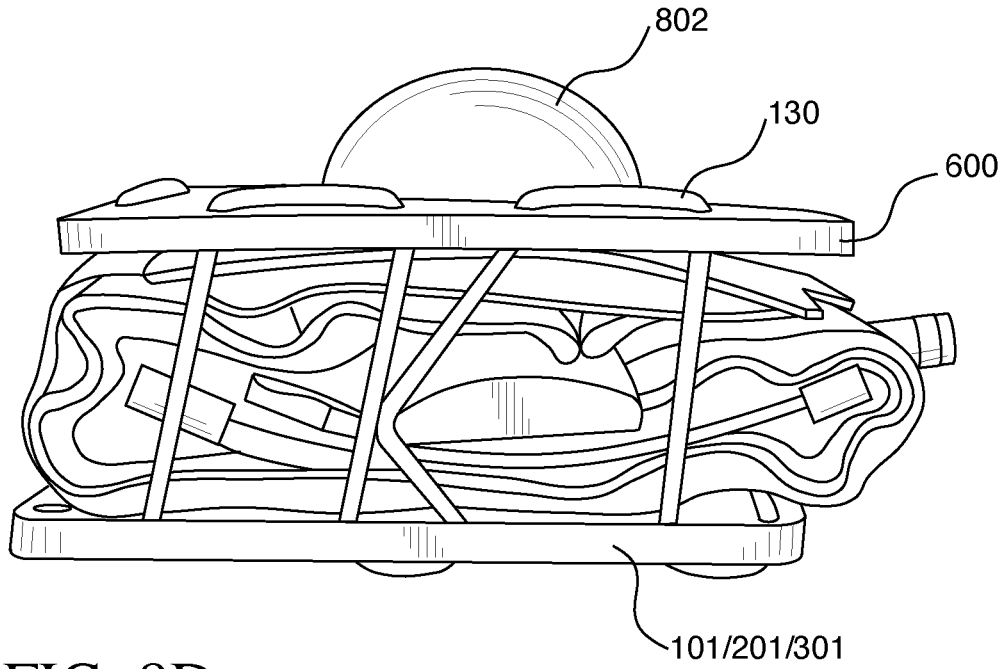
Figure 8E:
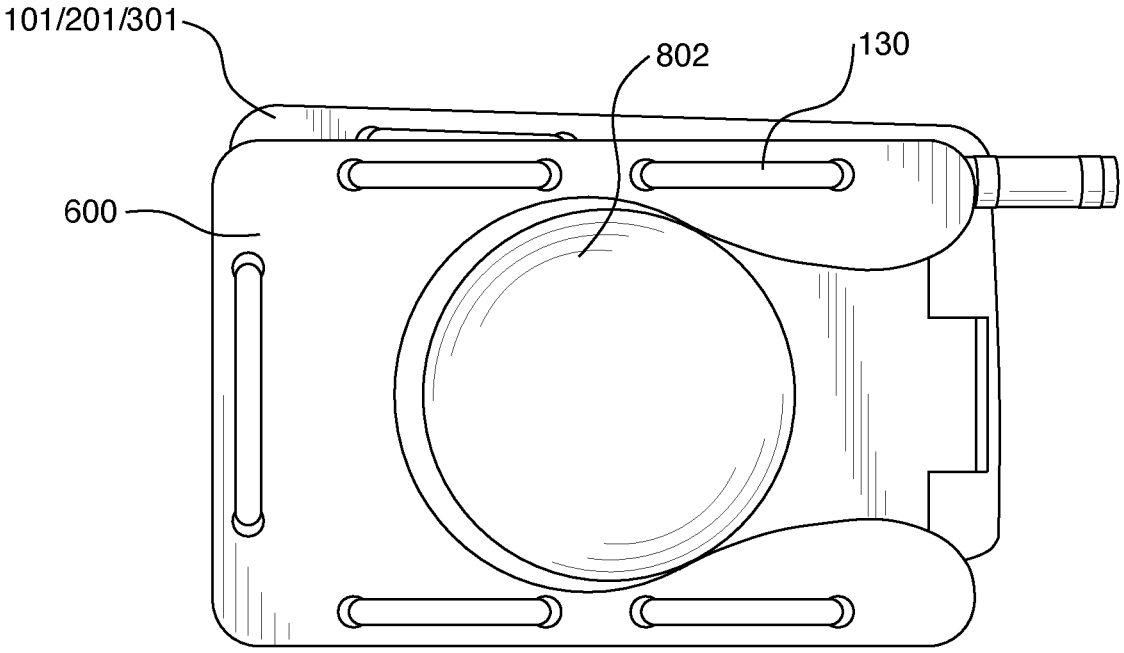

FIGS. 7A and 7B illustrate top plates 600 in accordance with one aspect of the present invention. The top plates 600 are approximately the same size as the baseplates 101, 201, 301 and include notches 620 around the periphery of the top plates 600. The notches 620 in the top plates align with the notches in the baseplates and the elastic shock cord is woven through the two sets of notches to removably couple the top plates 600 to the baseplates. The top plates 600 may additionally include openings 602 in the central portion thereof. The openings 602 may have different designs, shapes, and sizes, depending on the item to be carried in the holster. For example, as shown in FIGS. 7A, 8D, and 8E the top plate 600 includes a rounded opening 602 to accommodate a point pressure device 802.

The top plate 600, baseplate 101, 201, 301, and elastic shock cord 130 may be provided together as a kit. When the kit is assembled, the notches 620 in the top plate 600 align with the notches in the baseplate, and the elastic shock cord 130 is woven through the aligned notches to removably couple the top plate and base plate together. As shown in FIGS. 8A-8E, desired items 802, 804 to be carried by the holster are sandwiched between the top plate 600 and the baseplate 101, 201, 301 and are held in place with the tension in the elastic shock cord 130. The items 802, 804 can thus be quickly and easily removed from the holster without getting tangled or caught up on the elastic shock cord.

Additional Considerations

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

What is claimed is:

1. A holster for attaching an item to a garment, wherein the holster comprises:

a baseplate comprising a central portion and a peripheral portion;

a first opening in the central portion of the baseplate, wherein the first opening is sized and shaped to accommodate a belt, strap, or MOLLE webbing; and a plurality of notches positioned around the peripheral portion of the baseplate such that the plurality of notches surround the first opening, wherein the plurality of notches are sized and shaped to accommodate a tethering member passing therethrough, wherein the plurality of notches comprises a first notch having a first rounded portion and a first narrow channel, and a second notch having a second rounded portion and a second narrow channel, and wherein the first narrow channel extends from the first rounded portion towards the second narrow channel, and the second narrow channel extends from the second rounded portion towards the first narrow channel; and wherein the first opening in the central portion of the baseplate is a channel surrounding a T-shape tab that is coplanar with the baseplate.

2. The holster of claim 1, wherein the first and second rounded portions comprise an inner diameter larger than an outer diameter of the tethering member so that the first and second notches do not interfere with the tethering member passing through the first and second notches when the tethering member is disposed in the first and second rounded portions, and wherein the first and second narrow channels comprise a width that is less than the outer diameter of the tethering member so that the tethering member is compressed when the tethering member is positioned in the first or second narrow channel, thereby locking the tethering member in place relative to the baseplate.

3. The holster of claim 1, further comprising a second opening in the central portion of the baseplate, wherein the second opening has a size and shape similar to the size and shape of the first opening.

4. The holster of claim 1, wherein the T-shaped tab is configured to engage MOLLE webbing.

5. The holster of claim 4, wherein the T-shaped tab comprises a base portion coupled to the central portion of the baseplate and an open top portion opposite of the base portion.

6. The holster of claim 5, further comprising side tabs in the peripheral portion of the baseplate, wherein the side tabs are configured to engage MOLLE webbing.

7. The holster of claim 1, wherein the baseplate is made of a rigid material.

8. The holster of claim 1, wherein the baseplate is made of a semi-rigid material.

* * * * *